US005547236A

United States Patent [19]

Gregory

[11] Patent Number: 5,547,236

[45] Date of Patent: Aug. 20, 1996

[54] REMOVABLE DOOR LOCK

[76] Inventor: John E. Gregory, 803 Ricky Dr., Campbell, Calif. 95008

[21] Appl. No.: 393,568

[22] Filed: Feb. 23, 1995

[51] Int. Cl.[6] ..... E05C 1/04

[52] U.S. Cl. ..... 292/148; 292/258; 292/288

[58] Field of Search ..... 292/148, 258, 292/288, 302

[56] References Cited

U.S. PATENT DOCUMENTS

| | | | |
|---|---|---|---|
| 3,961,816 | 6/1976 | Mueller | 292/148 |
| 3,997,206 | 12/1976 | Hagopian | 292/258 X |
| 4,198,088 | 4/1980 | Tochihara | 292/288 |
| 4,326,394 | 4/1982 | Stein | 70/14 |
| 4,330,146 | 5/1982 | Sessions, Jr. | 292/258 |
| 4,405,165 | 9/1983 | Johns | 292/258 |
| 4,529,235 | 7/1985 | Florentine | 292/258 |
| 4,653,785 | 3/1987 | Tobey | 292/258 |
| 4,653,786 | 3/1987 | Bopst | 292/295 |

FOREIGN PATENT DOCUMENTS

| | | | |
|---|---|---|---|
| 509856 | 3/1952 | Belgium | 292/148 |

*Primary Examiner*—Rodney M. Lindsey
*Attorney, Agent, or Firm*—Robert Samuel Smith

[57] ABSTRACT

A device for temporarily locking a door which has an extension arm having one end secured perpendicularly to a channel straddling an edge of the door and extending away from the channel and a retainer arm telescoped onto the retainer arm that can be oriented either vertically or horizontally for engagement with the wall so that the locking device can be positioned at any location on either the top or vertical unhinged edge of the door. A bar may also be attached to the retaining arm when the retaining arm is oriented in the horizontal position. The means for securing the device to the door is also provided with an adjustable spacer means for attachment to a door having one of a range of thicknesses.

4 Claims, 2 Drawing Sheets

REMOVABLE DOOR LOCK

BACKGROUND

1. Field of the Invention

This invention relates to a locking device that may be mounted temporarily on any one of several door styles such as a rollup garage doors and particularly to a locking device that hooks onto the side or top edges of a rollup door where it may be secured with a padlock.

2. Prior Art and Information Disclosure

Numerous situations exist where it is required to temporarily attach a locking device to a door such that the door may only be unlocked and opened by an authorized individual. For example, in the pest control industry, a number of states have laws requiring, that when a building such as a garage or home is being fumigated, in which case, the building is filled with a lethal gas, a temporary lock must be mounted on all doors and that lock device may be unlocked ONLY by the fumigator.

A number of locking devices have been disclosed which are temporarily attachable and lockable to the outside of a door.

For example, U.S. Pat. No. 4,653,786 to Bopst discloses an "L" strap having one leg slidably secured against the the center leg of a "U" strap such that the center leg of the "U" strap is positionable between the vertical edge of the door and the door frame with one angled end of the "U" strap engaging a latch socket in the door, the second angled end of the "U strap" accessible to the user for positioning the device and an angled end of the "L" abutting the door frame.

U.S. Pat. No. 4,653,785 to Tobey discloses a locking device that is attached to the upper corner of a door such as a door in a hospital room. The device has a "corner bracket for receiving the corner portion of the door and including a top wall and an end wall perpendicular to one another and connecting parallel opposing walls" such that the bracket can fit only on the corner of the door. An arm extending from the backer extends through a flat plate which fits into the corner of the door frame and has a vertical edge and a horizontal edge which engage the horizontal and vertical members of the door frame. The plate is secured by a lock in the extending arm. The use of this device is limited in that the device may be secured only at the corner of the door and may not be attached at an arbitrary location along the top edge or the side edge of the door. Attachment of the device to an edge of the door would be particularly important for a short user not having a ladder to stand on to attach the device to the top corner or for standing on to remove or attach the padlock. The retainer plate may fit only where there is a vertical jamb and a horizontal jamb inside the frame against which the closed door abuts. The device can not be used for a rollup garage door.

U.S. Pat. No. 4,529,235 to Florentine discloses a device for temporarily locking a door closing against a jamb and having an empty cylinder hole, the device comprising a door grabbing element which abuts against one side of the door and a jamb grabbing element which abuts the jamb on a side opposite the door grabbing element and a connecting element that connects the two elements such as,to secure the door against the jamb.

U.S. Pat. No. 4,326,394 to Stein discloses a detachable door lock device including an elongated member insertable between the edge of a closed door and the door frame with an adjustable first retaining member attachable in a selected position of several positions on the back side of the door so as to accommodate doors having any one of several thicknesses and an "L" shaped second retaining member positioned on a front end of the elongated member and securable to a selected one of several positions by a padlock. When the door is secured, an end of one leg of the "L" is against the wall adjacent the door frame and the end of the other leg is against the door.

U.S. Pat. No. 4,198,088 to Tochihara discloses a door locking device deployable to engage the floor and keep the door from opening.

U.S. Pat. No. 4,405,165 to Johns is for a demountable door locking device for locking a door from either side and having a member lockable to the door jamb.

The problem with all of these devices is that none of the locks accommodate a range of door frame constructions such as, for example, a range of thicknesses of the wall.

THE INVENTION

Objects

In view of the limitations discussed in connection with the devices of the prior art, it is therefore an object of this invention to provide an attachable lock that that can be attached and locked anywhere along any unhinged edge of the door, including the top and bottom and vertical edges.

It is another object that the same device be adapted for use on any door construction having one of a large range of frame widths including frame widths that are very narrow as when the walls are relatively thin and frame widths that are very wide as when the walls are relatively thick.

It is another object that the same device be adaptable to door flames having a variety of constructions such as a rollup garage door or a conventional house door.

It is another object that the device be adaptable to doors having any one of a range of thicknesses and that the device be firmly (not loosely) mounted on the door even when the door is opened.

It is a further object that the construction of the device be amenable to providing heavy padding between the side of the wall and the retaining member of the device if desired in order to protect the wall from rough treatment from vandals, etc.

Summary

The detachable lock of this invention is directed toward a wall clamp member that abuts against the wall adjacent a door frame by telescoping onto an extending member of a door clamp member that is attachable at any location along any unhinged edge of a door.

In one embodiment, the extending member is a square rod or tube having one end secured to a door clamp that is detachably mounted on the edge of the door such that the extending member is perpendicular to the door. The wall clamp member includes an arm having one end secured perpendicularly to a tube that telescopes onto the rod so that the arm may be slidably positioned firmly against the wall where it is secured by a lock through the telescoping tube and extending member. In a modification of this embodiment, the retaining arm is oriented in the horizontal position and a solid bar, secured to the retaining arm, has a length such that the bar extends across the entire width of the door frame. In another variation of this embodiment, the door clamp member comprises a channel with a threaded screw through one side panel of the channel which may be used to force an extra panel against the door so that any thickness of the door in a range of thicknesses may be accommodated.

In yet another embodiment, the door clamp comprises an inserted member positioned between the closed door and the door frame and a cross bar on an end of the inserted member has one end that engages the backside of the door and an opposite end that engages the inside surface of the wall adjacent the door, this construction is especially adapted for securing "swing out" garage doors.

DRAWINGS

DESCRIPTION OF PREFERRED EMBODIMENTS

Figure 1:
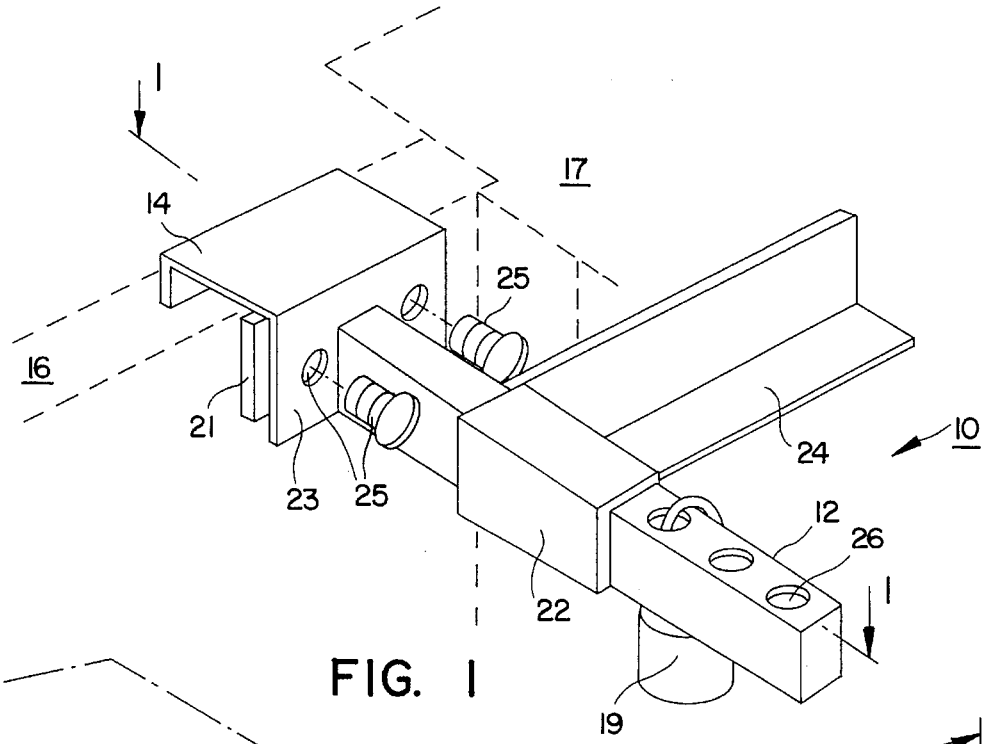
FIG. 1 is a perspective view showing one embodiment of the invention used when hooking the device to top edge of the door.

Turning now to a discussion of the drawings, FIG. 1 shows one embodiment of the invention 10 including an extending member 12 having a square cross section and an end perpendicularly secured to panel 23 of channel 14. A tube 22 telescopes onto extending member 12. and an angle retaining arm 24 has one end secured perpendicularly against the side of the telescoping tube 22. A padlock 19 inserted through any of the apertures 26 secures the telescoping tube 22 in its position on the extending member 12.

As various arrangements in FIGS. 1–8 show, the door 16 is secured in the closed position against the frame 17 by the extension member 12 having one end secured to the door 16 by various arrangements and the retaining arm 24 with one end attached to the telescoping tube 22 telescoped onto the extension member 12 being slidably positioned against the wall 17 and secured by a padlock 19 through one of the apertures 26 in the extension member 12. Versatility in mounting the device 10 in the locking position resides in the ability to orient the retaining arm 24 either vertically or horizontally on the extension member 12.

Channel 14 also straddles a spacing panel 23 located between the door 16 and side panel 23 By adjusting the set screws 25 threaded into panel 23 of channel 14, the channel 14 can be clamped onto any door 16 having a selected one of a range of thicknesses.

Figure 2:
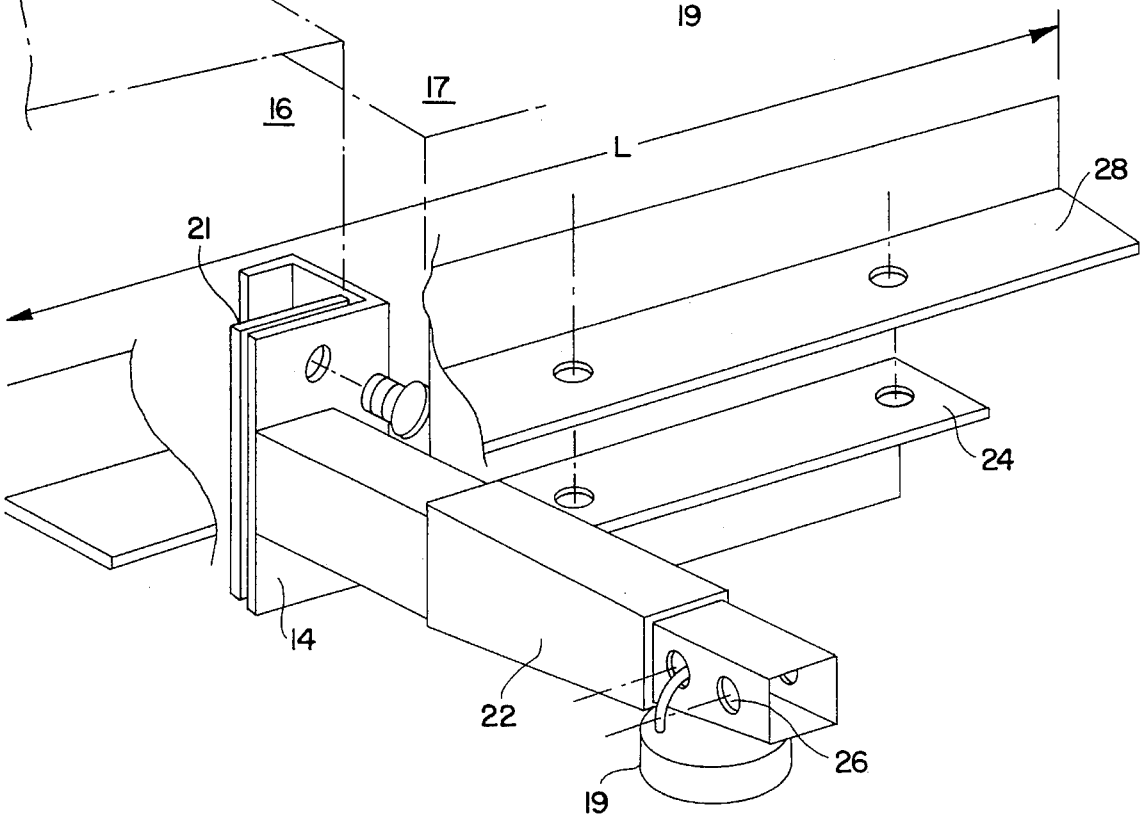
FIG. 2 shows the device of FIG. 1 where the retaining arm is horizontal and the channel is vertical permitting mounting the device on the vertical edge of the door.
Figure 3:
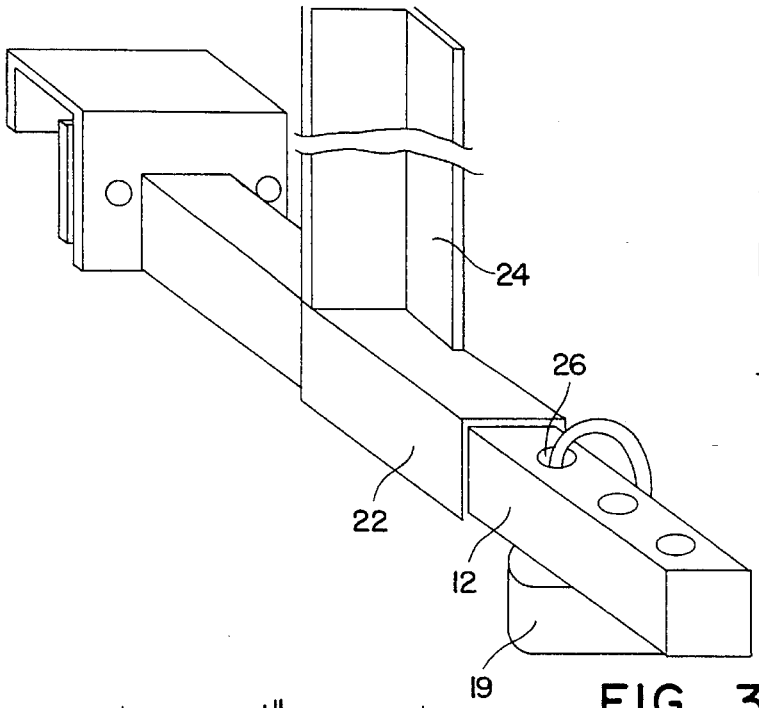
FIG. 3 shows the device with the retaining arm vertical. permitting locating the device anywhere on the top edge of the door.
Figure 7:
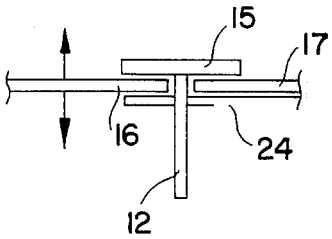
FIG. 7 shows the embodiment of FIG. 6 mounted on a swingout door.
Figure 8:
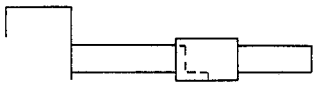
FIG. 8 shows a sectional view of FIG. 1 illustrating the open ended channel permitting locating the device any where on the top or vertical edge of the door.

The numerous selections available for positioning and locating the device is enabled by the unique construction of the device residing in the open ended channel and the square telescoping tube. The sectional view 1—1 of FIG. 8 shows that channel 14 is open on both ends. As shown in FIGS. 1–8, the telescoping tube 22 with rectangular cross section may be telescoped onto extending member 12 with arm 24 either vertical or horizontal. so that the channel 14 is adapted for straddling a door 16 (the door 16 is shown in phantom) at any location along the top edge 18 of the door. As shown in FIG. 2, the same device may also be located anywhere along the vertical edge 20 of the door 16. The versatility in locating the device overcomes a number of problems encountered in the field. One potential problem occurs if the user is short so that he/she cannot reach the top edge of the door. This would preclude the use of devices of the prior art that attach only to the upper corner of the door. However the device of the present invention can be located at a lower level along the vertical edge of the door with the arm 24 oriented horizontally as shown in FIG. 2.

Figure 4:
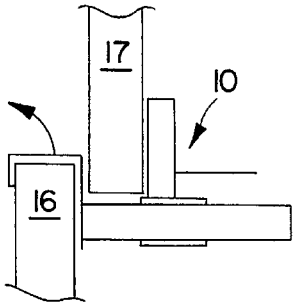
FIG. 4 illustrates use of the device on a rollup garage door.

FIG. 4 is a sectional view showing the use of he device 10 to prevent opening a rollup garage door. The arm 24 is oriented vertically and the device 10 is located anywhere on the top edge of the door.

Figure 5:
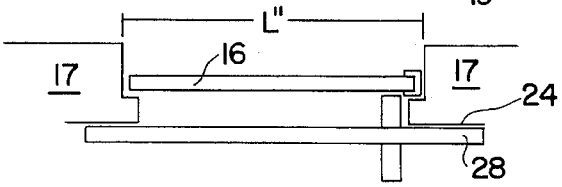
FIG. 5 illustrates use of the device with a cross bar.

FIG. 2 shows an embodiment in which a cross bar (angle) 28 may be attached to the arm 24 arranged horizontally. FIG. 5 shows the cross bar 28 extending across the door 16 and door frame 17 thereby adding additional resistive strength against forces attempting to open the door.

Figure 6:
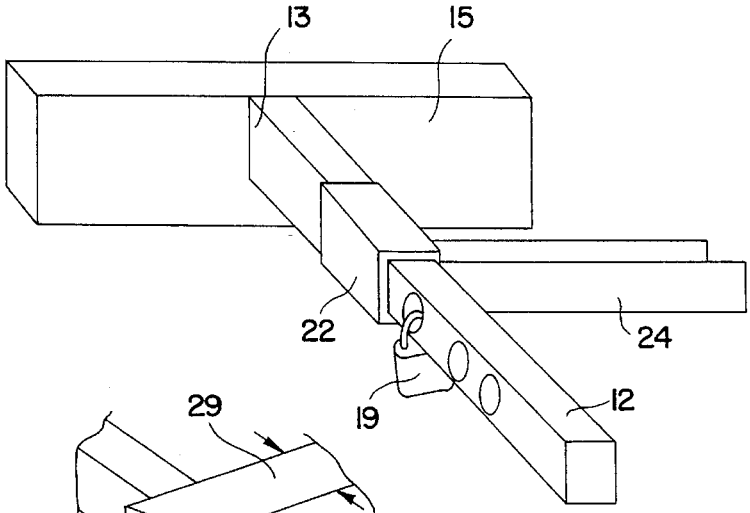
FIG. 6 shows an embodiment of the device for use with a swingout door.

FIG. 6 shows an embodiment of the invention that is useful in situations requiring such as securing "swing out" garage doors where sufficient spacing usually occurs between the vertical edge of the door and the frame. In this embodiment, the extension with telescoping tube 22 mounted thereon has an end 13 secured vertically onto a cross bar 15. As shown in FIG. 7, extension member 12 extends between "swingout (garage door) 16 and wall 17.

Figure 9:
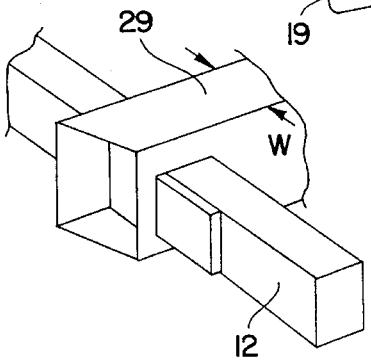
FIG. 9 shows another construction for achieving the telescoping feature.

A device for temporarily locking a door has been described which is a substantial improvement over devices of the prior art in terms of the versatility with which the device can be used in a number of locations and to accommodate a variety of door constructions. Modifications of the invention may occur after reading the specifications and studying the drawings which are within the scope of the invention. For example, the extension arm and telescoping tube may be round, or triangular or rectangular. As shown in FIG. 9, the telescoping member (robe) may have sufficient breadth that the telescoping feature is accomplished by a square hole in the retaining arm 29. I therefore wish to define the scope of the invention by the appended claims and in view of the specification if need be.

I claim:

1. A temporary locking device for a door having a horizontal top edge and an unhinged vertical edge and said door having a backside opposite a front side and closing with said front side against a door jamb of a door frame in a wall, said device comprising:

an elongated extension arm having a square cross section;

means adapted for detachably attaching one end of said extension arm to said door proximal to one of said top edge and said vertical edge at any location on said edges such that said extension arm is perpendicular to said door;

a tubular telescoping member that telescopes onto said extension arm;

a retainer arm having an end perpendicularly attached to a side of said telescoping member providing that, when said extension arm is secured to said door by said means for attaching, said retainer arm is enabled to be slidably positioned against a front side of said wall such that said retainer arm is fixable in both of a horizontal orientation and a vertical orientation at said any location along said one of said top edge and said vertical edge;

said extension member having a row of apertures;

each aperture arranged to receive a padlock such as to secure said telescoping tube member in a position on said extension arm selected to retain said retaining arm against said wall.

2. The device of claim 1 wherein said means for attaching comprises:

a channel having a first side panel and a second side panel, each first and second side panel having an edge joined perpendicularly to opposite edges of a joining panel, respectively;

said extension member having one end secured perpendicularly to said first side panel and extending away from said channel;

said joining panel having a width between said opposite edges to enable said channel to be positioned astraddle an edge of said door.

3. The device of claim 2 which comprises:

a spacer panel positioned between said first and second side panels;

at least one set bolt threaded into said first side panel such that when said channel is astraddle said door and said spacer panel, said at least one spacer bolt is positionable to force said spacer panel against said door thereby firmly securing said channel onto said door.

4. A device as in claim 1 wherein said attaching means is a cross bar secured across said one end of said extension arm and adapted such, that when said extension arm is positioned between an edge of said door and said wall, said cross bar is adapted to be positionable against said backside and when said retaining arm is positioned against a front side of said wall, said door is secured in a closed position.

* * * * *